US007063069B2

(12) United States Patent
Sakai et al.

(10) Patent No.: US 7,063,069 B2
(45) Date of Patent: Jun. 20, 2006

(54) INTERNAL COMBUSTION ENGINE CONTROLLER

(75) Inventors: Mitsuto Sakai, Toyota (JP); Daichi Yamazaki, Toyota (JP); Tatsuhiko Akita, Toyota (JP); Naoki Kurata, Aichi-ken (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/050,734

(22) Filed: Feb. 7, 2005

(65) Prior Publication Data

US 2005/0193981 A1 Sep. 8, 2005

(30) Foreign Application Priority Data

Mar. 2, 2004 (JP) ..... 2004-057943

(51) Int. Cl.
*F02M 63/02* (2006.01)
*F02B 15/00* (2006.01)

(52) U.S. Cl. ..... 123/431; 123/299

(58) Field of Classification Search ..... 123/299, 123/300, 431
See application file for complete search history.

(56) References Cited

U.S. PATENT DOCUMENTS 6,357,417 B1 * 3/2002 Kato ..... 123/431
6,786,201 B1 * 9/2004 Ohtani ..... 123/431
7,007,662 B1 * 3/2006 Sakai et al. ..... 123/299

FOREIGN PATENT DOCUMENTS

JP A 07-103048 4/1995

* cited by examiner

*Primary Examiner*—Erick Solis
(74) *Attorney, Agent, or Firm*—Oliff & Berridge, PLC

(57) ABSTRACT

An ECU for an internal combustion engine predicts change in the driving state of the engine when switching from port injection mode to in-cylinder injection mode. In accordance with the prediction, the ECU actuates a high-pressure pump before entering the in-cylinder injection mode to pressurize the fuel supplied to an air-intake passage injector.

18 Claims, 6 Drawing Sheets

INTERNAL COMBUSTION ENGINE CONTROLLER

CROSS-REFERENCE TO RELATED APPLICATIONS

This application is based upon and claims the benefit of priority from prior Japanese Patent Application No. 2004-057943, filed on Mar. 2, 2004, the entire contents of which are incorporated herein by reference.

BACKGROUND OF THE INVENTION

The present invention relates to a controller for adjusting the pressure of high-pressure fuel supplied to an in-cylinder injector of an internal combustion engine.

Japanese Laid-Open Patent Publication No. 7-103048 discloses a conventional controller for an internal combustion engine. The conventional controller controls an internal combustion engine that includes an in-cylinder injector and an air-intake passage injector for each of its cylinders. More specifically, when injecting fuel into a combustion chamber in each cylinder, the controller uses an appropriate one of the above two types of injectors according to the engine driving state of the internal combustion engine, such as the engine load and the engine speed.

When fuel is injected from the in-cylinder injector (in-cylinder injection mode), fuel having a high pressure (required fuel pressure) must be supplied to a high-pressure distribution pipe connected to the in-cylinder injector. In a port injection mode in which fuel is to be injected from an air-intake passage injector to an intake port, fuel having a pressure lower than the required fuel pressure is supplied to the air-intake passage injector. This is because the pressure of the intake port is relatively low and thus the air-intake passage injector does not need to inject fuel at high pressure.

In the in-cylinder injection mode, a high-pressure pump pressurizes fuel to raise the pressure of fuel in the high-pressure distribution pipe to the required fuel pressure. In the port injection mode, the high-pressure pump is stopped. Since the high-pressure pump is driven only when necessary, the fuel efficiency of the internal combustion engine is prevented from being lowered.

However, when the high-pressure pump is stopped in the port injection mode, the fuel pressure in the high-pressure distribution pipe is lowered. Thus, when shifting from the port injection mode to the in-cylinder injection mode, the required fuel pressure may not be immediately obtained. This is because even if the de-actuated high-pressure pump is actuated when the driving mode is shifted, the fuel pressure in the high-pressure distribution pipe cannot be instantaneously raised. In this case, in-cylinder injection is performed in a state in which the fuel pressure in the high-pressure distribution pipe is not high enough. As a result, large pulsations of the fuel pressure occur in the high-pressure distribution pipe. The pulsation causes the fuel injection amount to be unstable and degrades the combustion characteristics of the internal combustion engine.

To solve this problem, the high-pressure pump may be actuated even in the port injection mode whenever the fuel pressure in the high-pressure distribution pipe becomes less than or equal to a set pressure. This constantly keeps the fuel pressure in the high-pressure distribution pipe greater than or equal to a predetermined value.

The controller described above raises the fuel pressure in the high-pressure distribution pipe to the required fuel pressure at all times, including when shifting from the port injection mode to the in-cylinder injection mode. Thus, in-cylinder injection is performed in a stable manner. However, the controller actuates the high-pressure pump whenever the fuel pressure in the high-pressure distribution pipe becomes less than or equal to the set pressure in the port injection mode. This means that the high-pressure pump is actuated to maintain the fuel in the high-pressure distribution pipe at the required fuel pressure regardless of whether the driving state is shifted from the port injection mode to the in-cylinder injection mode. Accordingly, the high-pressure pump may be actuated even when there are no changes in the driving state. This lowers fuel efficiency of the internal combustion engine.

SUMMARY OF THE INVENTION

It is an object of the present invention to provide a controller for an internal combustion engine that adjusts the pressure of fuel supplied to an in-cylinder injector and an air-intake passage injector in order to prevent the fuel efficiency of the engine from being lowered.

One aspect of the present invention is a controller for an internal combustion engine. The internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector. The internal combustion engine has a first driving mode, in which fuel is injected only from the air-intake passage injector, and a second driving mode, in which fuel is injected from the in-cylinder injector. The controller includes a prediction means for predicting whether the internal combustion engine will shift from the first driving mode to the second driving mode based on a driving state of the internal combustion engine. A pump control means controls fuel pressure in the high-pressure pipe. The pump control means operates the high-pressure pump at a first output when the prediction means predicts that the internal combustion engine is likely to shift from the first driving mode to the second driving mode. The pump control means de-actuates the high-pressure pump or operates the high-pressure pump at a second output lower than the first output when the prediction means predicts that the internal combustion engine is not likely to shift from the first driving mode to the second driving mode.

Another aspect of the present invention is a controller for an internal combustion engine. The internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector. The internal combustion engine has a first driving mode, in which fuel is injected only from the air-intake passage injector, and a second driving mode, in which fuel is injected from the in-cylinder injector. The controller includes a pressure sensor for detecting pressure of the fuel in the high-pressure pipe and generating a detection signal according to the detected pressure. A computer controls the high-pressure pump according to the detection signal of the pressure sensor. The computer predicts whether the internal combustion engine will shift from the first driving mode to the second driving mode based on a driving state of the internal combustion engine, operates the high-pressure pump at a first output when predicting that the internal combustion engine is likely to shift from the first driving mode to the second driving mode, and de-actuates the high-pressure pump or operates the high-pressure pump at a second output lower than the first output when predicting that the internal combustion engine is not likely to shift from the first driving mode to the second driving mode.

Another aspect of the present invention is a controller for an internal combustion engine. The internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a fuel tank and supplying low-pressure fuel to the air-intake passage injector, and a high-pressure pump for pressurizing the low-pressure fuel and supplying high-pressure fuel to the in-cylinder injector. The internal combustion engine has a plurality of driving modes including a first driving mode, in which fuel is injected only from the air-intake passage injector, and a second driving mode, in which fuel is injected from the in-cylinder injector. The controller includes a pressure sensor for detecting pressure of the high-pressure fuel and generating a detection signal according to the detected pressure. A computer adjusts output of the high-pressure pump according to the detection signal of the pressure sensor. The computer is programmed to predict whether the internal combustion engine will exit from the first driving mode based on a driving state of the internal combustion engine, operate the high-pressure pump at a first output when predicting that the internal combustion engine is likely to exit from the first driving mode, and de-actuate the high-pressure pump or operate the high-pressure pump at a second output lower than the first output when predicting that the internal combustion engine will remain in the first driving mode.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A controller for an internal combustion engine according to a preferred embodiment of the present invention will now be described. In the preferred embodiment, the internal combustion engine is a four-cylinder gasoline engine.

Figure 1:
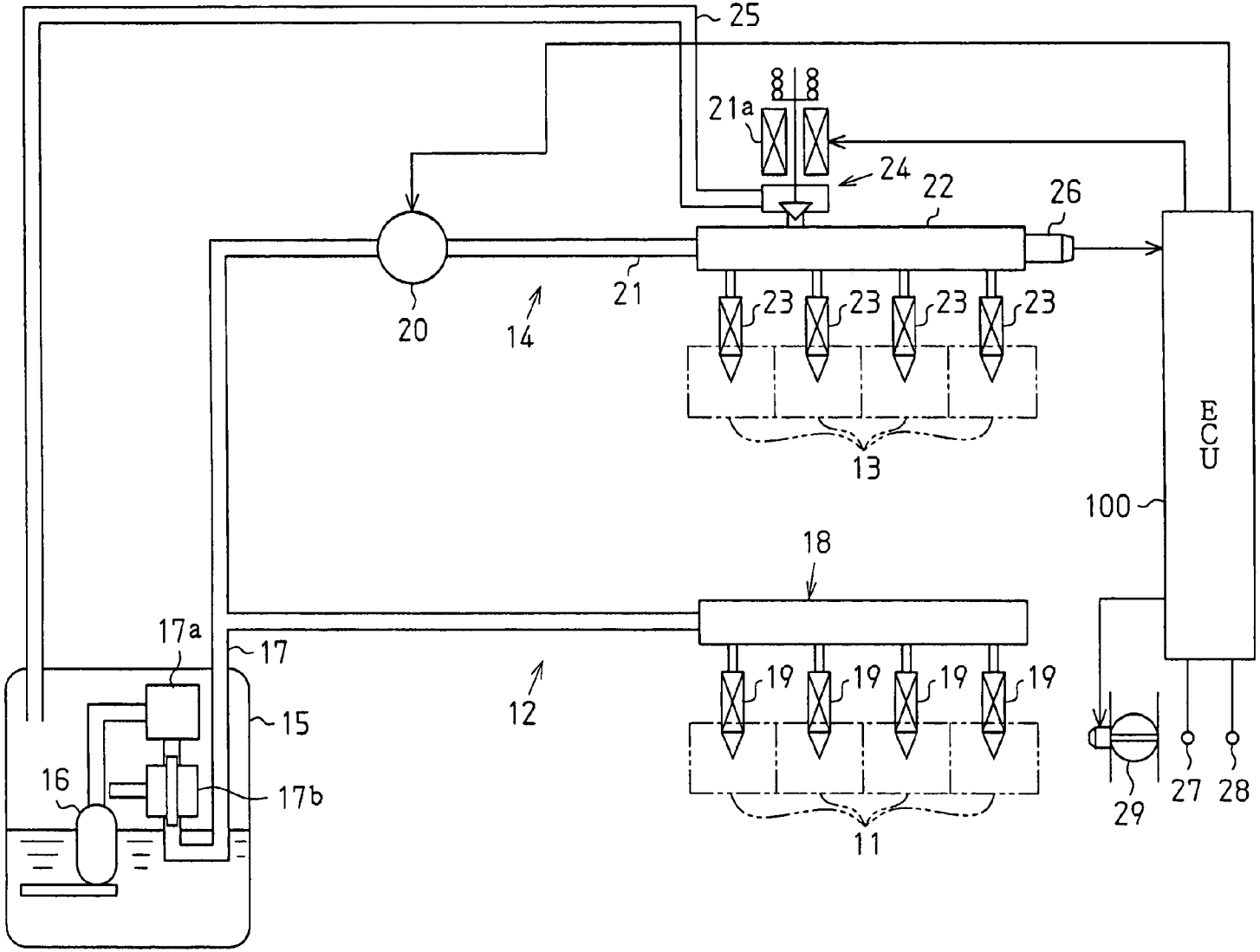
FIG. 1 is a schematic diagram of a controller for an internal combustion engine according to a preferred embodiment of the present invention.

As shown in FIG. 1, a fuel circulation system for the internal combustion engine includes a low-pressure fuel system 12 for injecting fuel into intake ports 11 of an air-intake passage, and a high-pressure fuel system 14 for directly injecting fuel into combustion chambers 13.

The low-pressure fuel system 12 includes a fuel tank 15 containing fuel, and a feed pump 16 (low-pressure pump) for pumping fuel. Fuel is pumped up by the feed pump 16 and fed to a low-pressure distribution pipe 18 (low-pressure pipe) via a filter 17*a* and a pressure regulator 17*b*, which are arranged in a low-pressure fuel passage 17. The filter 17*a* filters the fuel. The pressure regulator 17*b* adjusts the pressure of fuel in the low-pressure fuel passage 17. In the preferred embodiment, the pressure regulator 17*b* returns the fuel in the low-pressure fuel passage 17 to the fuel tank 15 when the fuel pressure in the low-pressure fuel passage 17 is greater than or equal to a predetermined pressure (e.g., 0.4 Mpa) so that the fuel pressure in the low-pressure fuel passage 17 is maintained below the predetermined pressure. The low-pressure distribution pipe 18 distributes low-pressure fuel to an air-intake passage injector 19 arranged for each cylinder of the internal combustion engine. Each air-intake passage injector 19 injects fuel into its corresponding intake port 11.

The high-pressure fuel system 14 includes a high-pressure pump 20, which is connected to the low-pressure fuel passage 17. The high-pressure pump 20 pressurizes low-pressure fuel and discharges fuel having a relatively high pressure to a high-pressure fuel passage 21. The pressure of the fuel in the high-pressure distribution pipe 22 is raised in this way. The high-pressure distribution pipe 22 distributes high-pressure fuel to an in-cylinder injector 23 arranged in each cylinder of the internal combustion engine. When each in-cylinder injector 23 is open, fuel is directly injected into its corresponding combustion chamber 13.

A relief valve 24 is arranged in a drain passage 25 connecting the high-pressure distribution pipe 22 and the fuel tank 15. In the preferred embodiment, the relief valve 24 is an electromagnetic valve that opens in response to voltage applied to an electromagnetic solenoid 24*a*. When the relief valve 24 is open, high-pressure fuel in the high-pressure distribution pipe 22 is returned to the fuel tank 15 via the drain passage 25.

Figure 2:
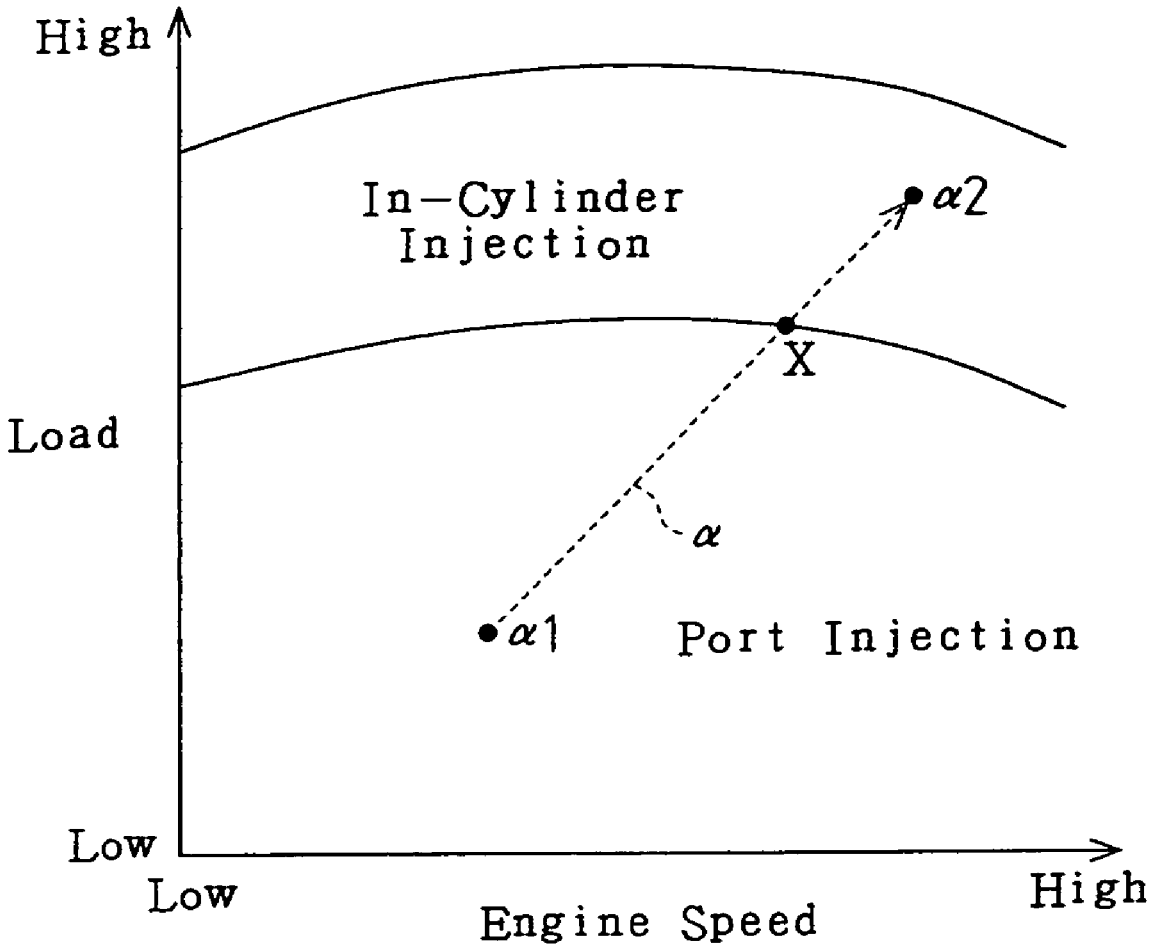
FIG. 2 is a chart showing driving modes of the internal combustion engine in which the vertical axis represents the engine load and the horizontal axis represents the engine speed.

FIG. 2 is a chart showing the range for a port injection mode (port injection mode range), in which fuel is injected only from the air-intake passage injectors 19, and the range of an in-cylinder injection mode (in-cylinder injection mode range), in which fuel is injected from the in-cylinder injectors 23. The vertical axis represents the engine load. The horizontal axis represents the engine speed.

Basically, the internal combustion engine uses the air-intake passage injectors 19 or the in-cylinder injectors 23 in accordance with the engine load. For example, when the engine load of the internal combustion engine is high, the amount of intake air in the combustion chambers 13 is large. Thus, enhanced atomization of fuel in the combustion chambers 13 can be expected. Accordingly, the in-cylinder injectors 23 directly inject fuel into the combustion chambers 13 using the cooling effect of the direct injection of fuel into the combustion chambers 13.

When the engine load of the internal combustion engine is low, the amount of intake air in the combustion chambers 13 is small. Thus, enhanced atomization of fuel in the combustion chambers 13 cannot be expected. In this case, the injection of fuel from the in-cylinder injectors 23 lowers the fuel efficiency of the internal combustion engine. Thus, fuel is injected only from the air-intake passage injectors 19 when the load is low.

The amount of intake air changes in accordance with the engine speed. Thus, the internal combustion engine uses the injectors 19 or 23 according to the engine load and the engine speed. When the in-cylinder injectors 23 inject fuel, the fuel pressure in the high-pressure distribution pipe 22 is required to be high.

As shown in FIG. 1, the controller for the internal combustion engine includes an electronic control unit (ECU) 100, or a computer, for controlling the high-pressure pump 20 and the relief valve 24. In the preferred embodiment, the ECU 100 also controls the entire internal combustion engine according to the driving state of the engine, such as control for adjusting the amount of fuel injected from the injectors 19 or 23, control for selecting the injectors 19 or 23, and control for adjusting the open degree of a throttle valve 29.

The ECU 100 is connected to a pressure sensor 26, which monitors the fuel pressure in the high-pressure distribution pipe 22. The ECU 100 is provided with a detection signal from the pressure sensor 26. An accelerator sensor 27 is attached to an accelerator pedal and provides the ECU 100 with a detection signal having a voltage proportional to the depressed amount of the accelerator pedal. A rotation speed sensor 28 is arranged, for example, in the vicinity of a crankshaft and provides the ECU 100 with a detection signal that is in accordance with the rotation speed of the crankshaft.

The ECU 100 calculates the engine load and the engine speed based on the detection signals provided from these sensors and determines the present driving state of the internal combustion engine (point $\alpha$ in the chart of FIG. 2). The point $\alpha$ moves to the right as the engine speed becomes higher, and moves upward as the engine load becomes higher. The ECU 100 determines whether the present driving state (point $\alpha$) is in the drive range in which the in-cylinder injectors 23 are to be used (in-cylinder injection mode range) or in a drive range in which the air-intake passage injectors 19 are to be used (port injection mode range). Based on the determination result, the ECU 100 selectively uses the injectors 19 or 23.

When the present driving state is in the port injection mode range (e.g., point $\alpha$1), the ECU 100 basically does not actuate the high-pressure pump 20. Since the high-pressure pump 20 is not actuated as it is unnecessary during port injection, the fuel efficiency of the internal combustion engine is prevented from being decreased by such actuation of the high-pressure pump 20.

When the present driving state is in the in-cylinder injection mode range (specific drive range) (e.g., point $\alpha$2), the ECU 100 actively actuates the high-pressure pump 20 to raise the fuel pressure in the high-pressure distribution pipe 22 to a target pressure, which is the pressure required to perform in-cylinder fuel injection.

When shifting from the port injection mode to the in-cylinder injection mode as indicated by the arrow drawn with a broken line in FIG. 2, that is, when the driving state shifts from point $\alpha$1 to point $\alpha$2, actuation of the high-pressure pump 20 is started when the driving state reaches point X. However, the fuel pressure in the high-pressure distribution pipe 22 does not immediately reach the target pressure after starting actuation of the high-pressure pump 20 at point X. Thus, fuel injection from the in-cylinder injectors 23 is unstable in the period from when the actuation of the high-pressure pump 20 is started to when the fuel pressure in the high-pressure distribution pipe 22 reaches the target pressure.

To solve this problem, the ECU 100 predicts whether the driving state is likely to be shifted from the port injection mode to the in-cylinder injection mode. When predicting that the shifting to the in-cylinder injection mode is likely, the ECU 100 actuates the high-pressure pump 20 in advance. In this way, the high-pressure pump 20 is actuated before the driving state is actually shifted to the in-cylinder injection mode. In this case, the fuel pressure in the high-pressure distribution pipe 22 is rising toward the target pressure at the time when the driving state reaches the point X. In-cylinder injection started in the process of shifting the driving state from the point $\alpha$1 to the point $\alpha$2 is performed in a state where the fuel pressure in the high-pressure distribution pipe 22 has been already raised. Thus, unstable fuel injection is prevented.

When predicting that shifting to the in-cylinder injection mode will not occur, the ECU 100 de-actuates the high-pressure pump 20. Thus, the high-pressure pump 20 is not driven when unnecessary, and the fuel efficiency of the internal combustion engine is prevented from being decreased by the high-pressure pump 20. In the preferred embodiment, the ECU 100 functions as a prediction means, a pump control means, a determination means, a suppression means, and a pressure lowering means.

Figure 3:
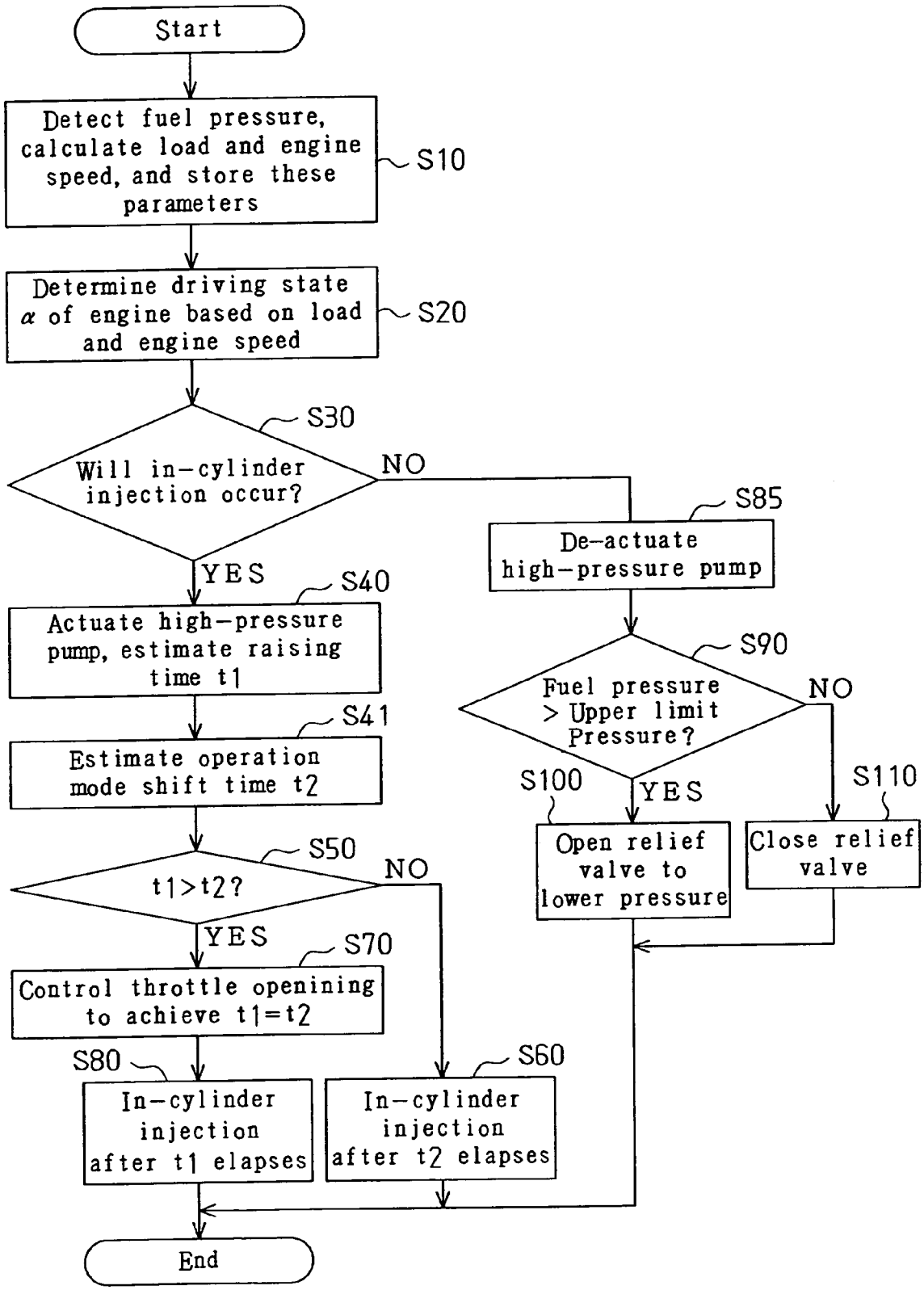
FIG. 3 is a flowchart showing control of fuel pressure in a high-pressure distribution pipe according to the preferred embodiment.

FIG. 3 is a flowchart showing control of the fuel pressure in the high-pressure distribution pipe 22. The ECU 100 repeatedly executes the process shown in the flowchart in predetermined time intervals of t seconds during the port injection mode.

In step S10, the ECU 100 detects the fuel pressure in the high-pressure distribution pipe 22 based on the detection signal of the pressure sensor 26. The ECU 100 calculates the engine load and the engine speed based on the detection signals of the accelerator sensor 27 and the rotation speed sensor 28. The ECU 100 stores these parameters (the fuel pressure, the engine load, and the engine speed) in, for example, a storage unit (such as a RAM) included in the ECU 100. The storage unit also stores parameters that were obtained in step S10 of cycles that have been executed in the past.

In step S20, the ECU 100 determines the present driving state (point $\alpha$ in FIG. 2) of the internal combustion engine in accordance with the engine load and the engine speed. In step S30, the ECU 100 predicts whether the driving state will be shifted to the in-cylinder injection mode. The prediction in step S30 will be described in detail later.

When shifting to the in-cylinder injection mode is likely to occur (YES in step S30), the ECU 100 actuates the high-pressure pump 20 in step S40 to raise the fuel pressure in the high-pressure distribution pipe 22 to the target pressure, which is the pressure required to perform in-cylinder injection. In step S40, the ECU 100 estimates the time (pressure raising time) t1 required for the high-pressure pump 20 to raise the fuel pressure (present fuel pressure) in the high-pressure distribution pipe 22 to the target pressure. In the preferred embedment, the ECU 100 calculates the change amount ΔP of the fuel pressure per a predetermined time of t seconds based on the present fuel pressure obtained in step S10 and the previous (past) fuel pressures stored in the storage unit. The ECU 100 calculates the pressure raising time t1 from the next equation:

pressure raising time t1=(target pressure−present fuel pressure)*(t/ΔP)

In step 41, the ECU 100 estimates the time (driving mode shift time) t2 required for the driving state to be shifted to the in-cylinder injection mode. Step S41 will be described in detail later.

In step S50, the ECU 100 compares the driving mode shift time t2 and the pressure raising time t1. When determining that the fuel pressure in the high-pressure distribution pipe 22 will be raised to the target pressure before the driving state is shifted to the in-cylinder injection mode (NO in step S50), the ECU 100 starts fuel injection from the in-cylinder injectors 23 in step S60 when the driving mode shift time t2 has elapsed.

When determining that the driving state will be shifted to the in-cylinder injection mode before the fuel pressure in the high-pressure distribution pipe 22 is raised to the target pressure (YES in step S50), the ECU 100 proceeds to step S70. For example, the driving state may be shifted to the in-cylinder injection mode before the fuel pressure in the high-pressure distribution pipe 22 is raised to the target pressure in the following case. During acceleration, the throttle valve may rapidly open to a large open degree to rapidly increase the engine load of the internal combustion engine. The rapidly increased engine load causes the driving state to be rapidly changed from the port injection mode to the in-cylinder injection mode. In step S70, the ECU 100 suppresses the change in the driving state so that the driving state is shifted to the in-cylinder injection mode simultaneously with or subsequent to when the fuel pressure in the high-pressure distribution pipe 22 reaches the target pressure. More specifically, the ECU 100 slows the speed at which the throttle valve opens. This slows the speed at which the engine load of the internal combustion engine increases and suppresses the shifting of the driving state from the port injection mode to the in-cylinder injection mode. In the preferred embodiment, the ECU 100 slows the opening speed of the throttle valve as the driving mode shift time t2 becomes shorter than the pressure raising time t1 so that the driving mode shift time t2 becomes equal to the target pressure raising time t1.

In step S80, the ECU 100 starts fuel injection from the in-cylinder injectors 23 when the pressure raising time t1 has elapsed.

When determining (predicting) that fuel injection from the in-cylinder injectors 23 is unlikely to be performed (NO in step S30), the ECU 100 de-actuates the high-pressure pump 20 in step S85. In step S90, the ECU 100 compares the fuel pressure in the high-pressure distribution pipe 22 obtained in step S10 with an upper limit pressure. The upper limit pressure is set so that fuel does not leak from the in-cylinder injectors 23. When the fuel pressure is higher than the upper limit pressure (YES in step S90), the ECU 100 opens the relief valve 24 in step S100. This lowers the fuel pressure in the high-pressure distribution pipe 22 until it becomes less than or equal to the upper limit pressure. When the result in step S90 is YES, the ECU 100 closes the relief valve 24 in step S110.

Figure 4:
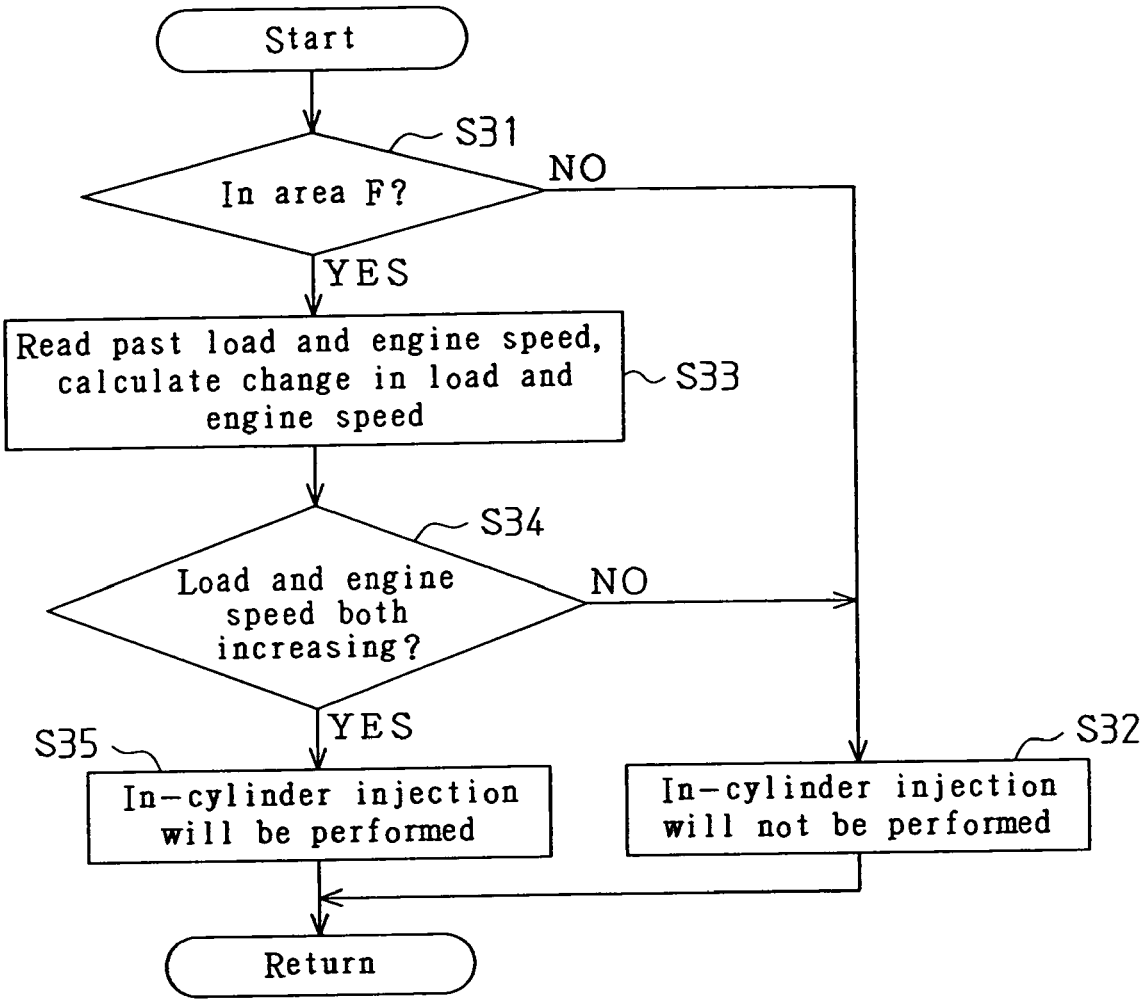
FIG. 4 is a flowchart showing control for predicting whether a driving state of the internal combustion engine will be shifted to an in-cylinder injection mode.

Step S30 will now be described in detail with reference to FIG. 4.

In step S31, the ECU 100 determines whether the driving state (point α) of the internal combustion engine determined in step S20 corresponds to a position close to the in-cylinder injection mode range in the port injection mode range.

Figure 5:
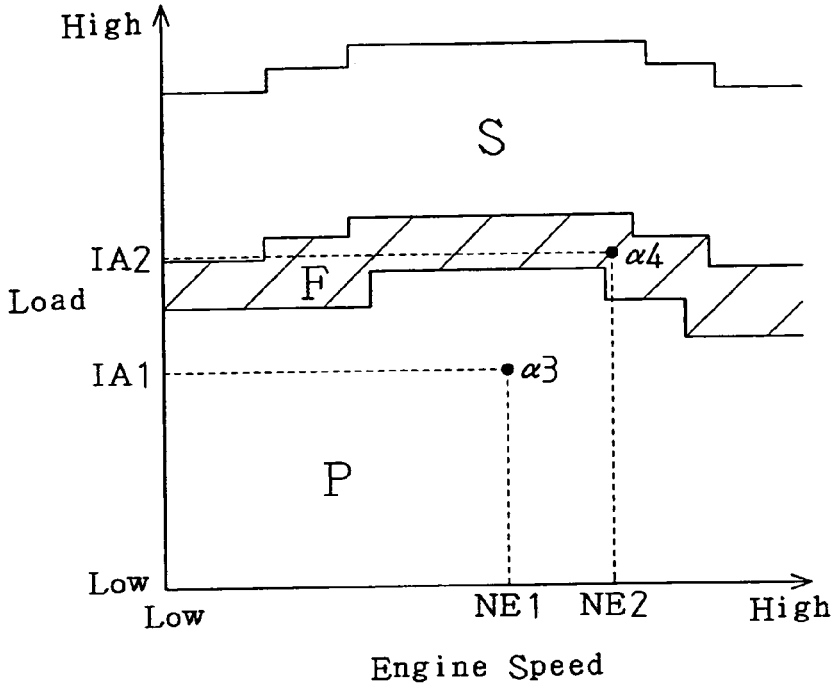
FIG. 5 is a map showing driving modes of the internal combustion engine in which the vertical axis represents the engine load and the horizontal axis represents the engine speed.

The ECU 100 stores an injection mode map M, which associates the engine load and the engine speed. The map M includes a port injection mode range P and an in-cylinder injection mode range S (FIG. 5). The port injection mode range P includes a prediction area F, which is close to the in-cylinder injection mode range S. The ECU 100 determines whether the driving state is in the prediction area F in step S31. When the driving state is in the prediction area F, the ECU 100 determines that there is a high possibility of shifting to the in-cylinder injection mode occurring. For example, when the driving state is at point α3, which corresponds to engine load IA1 and engine speed NE1, that is, when the driving state in the port injection mode range P is out of the prediction area F, the ECU 100 determines that the possibility of shifting to the in-cylinder injection mode is low (step S32).

When, for example, the driving state is at a point α4 (refer to FIG. 5), which corresponds to engine load IA2 and engine speed NE2, that is, when the driving state in the port injection mode range P is in the prediction area F (YES in step S31), the ECU 100 proceeds to step S33.

To improve the prediction reliability, in steps S33 and S34, the ECU 100 determines whether point α in the prediction area F is moving toward the in-cylinder injection mode range S. Steps S33 and S34 will now be described with reference to FIG. 6.

When the present driving state is at point α4 in the prediction area F, in step S33, the ECU 100 reads engine load IA2*b*1 and engine speed NE2*b*1, which were used to determine a past (e.g. previous) driving state (point α4*b*1), from the storage unit. The difference between the present engine load IA2 and the previous engine load IA2*b*1 is an engine load change amount ΔIA per a predetermined time of t seconds. The difference between the present engine speed NE2 and the previous engine speed NE2*b*1 is an engine speed change amount ΔNE per a predetermined time of t seconds.

In step S34, the ECU 100 checks whether the engine load change amount ΔIA and the engine speed change amount ΔNE are both positive values to determine whether both the engine load and the engine speed have increased. The positive change amount αIA indicates that the point α4 has moved up in the map M of FIG. 6. The positive change amount ΔNE indicates that the point α4 has moved right in the map M of FIG. 6. Thus, when both the change amount ΔIA and the change amount ΔNE are positive values, the point α4 is determined as moving toward the in-cylinder injection mode range S (YES in step S34).

When the result in step S34 is YES, the ECU 100 determines that there is a high possibility of the driving state shifting to the in-cylinder injection mode (step S35). When the result in step S34 is NO, the driving state is in the prediction area F but is not moving toward the in-cylinder injection mode range S. Thus, the ECU 100 determines that there is a low possibility of the driving state shifting to the in-cylinder injection mode (step S32).

Step S40 will now be described in detail with reference to FIGS. 6 and 7.

The ECU 100 calculates the time t2 required for the driving state to be shifted to the in-cylinder injection mode from the present engine load and speed and from the engine load change amount ΔIA and the engine speed change amount ΔNE per predetermined time of t seconds, which were calculated in step S30 (more accurately, in step S33).

Figure 6:
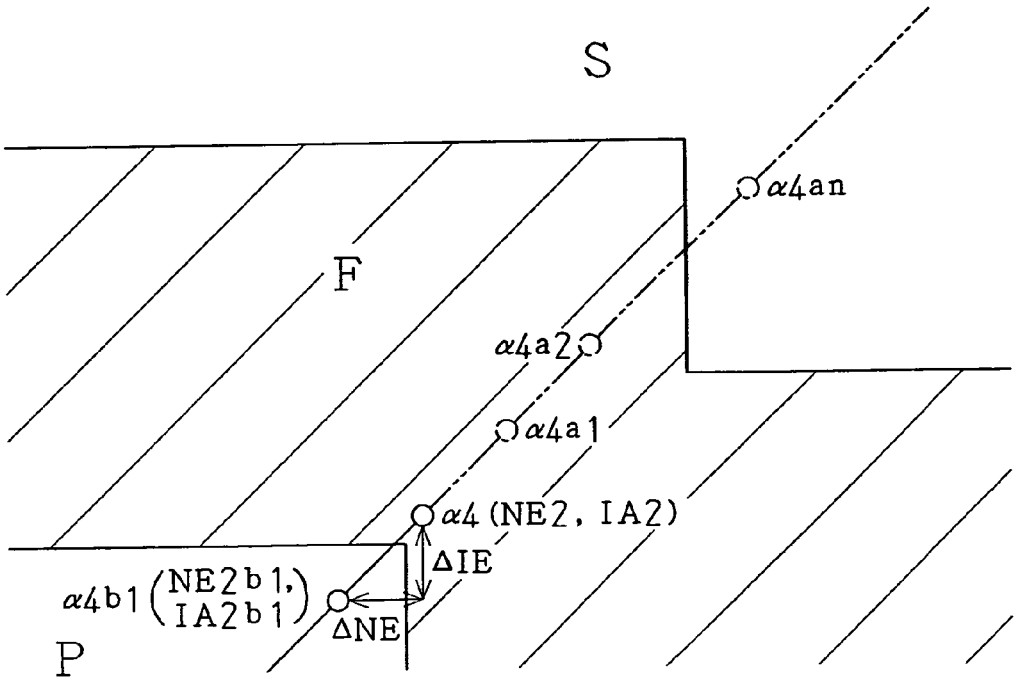
FIG. 6 is an enlarged view of the vicinity of point $\alpha$4 in the map of FIG. 5.

Assuming that the present driving state is at point α4 in FIG. 6, the ECU 100 adds the change amount ΔIA and the change amount ΔNE respectively to the present engine load IA2 and the present engine speed NE2 corresponding to point α4 to obtain a predicted position of the driving state on the map M after t seconds. The process of adding the change amount ΔIA and the change amount ΔNE is repeated until the predicted position becomes included in the in-cylinder injection mode range S. As shown in FIG. 6, the predicted position of the driving state moves toward the in-cylinder injection mode range S (toward the upper right side as viewed in FIG. 6, that is, moves to points α4*a*1, α4*a*2, and so on. When the predicted position becomes included in the in-cylinder injection mode range S (e.g., point α4*a*n), the ECU 100 multiplies the number of times the change amounts ΔIA and ΔNE were added (addition time n) by the predetermined time t to obtain the driving mode shift time t2. In other words, the equation of t2=n*t is calculated.

Figure 7:
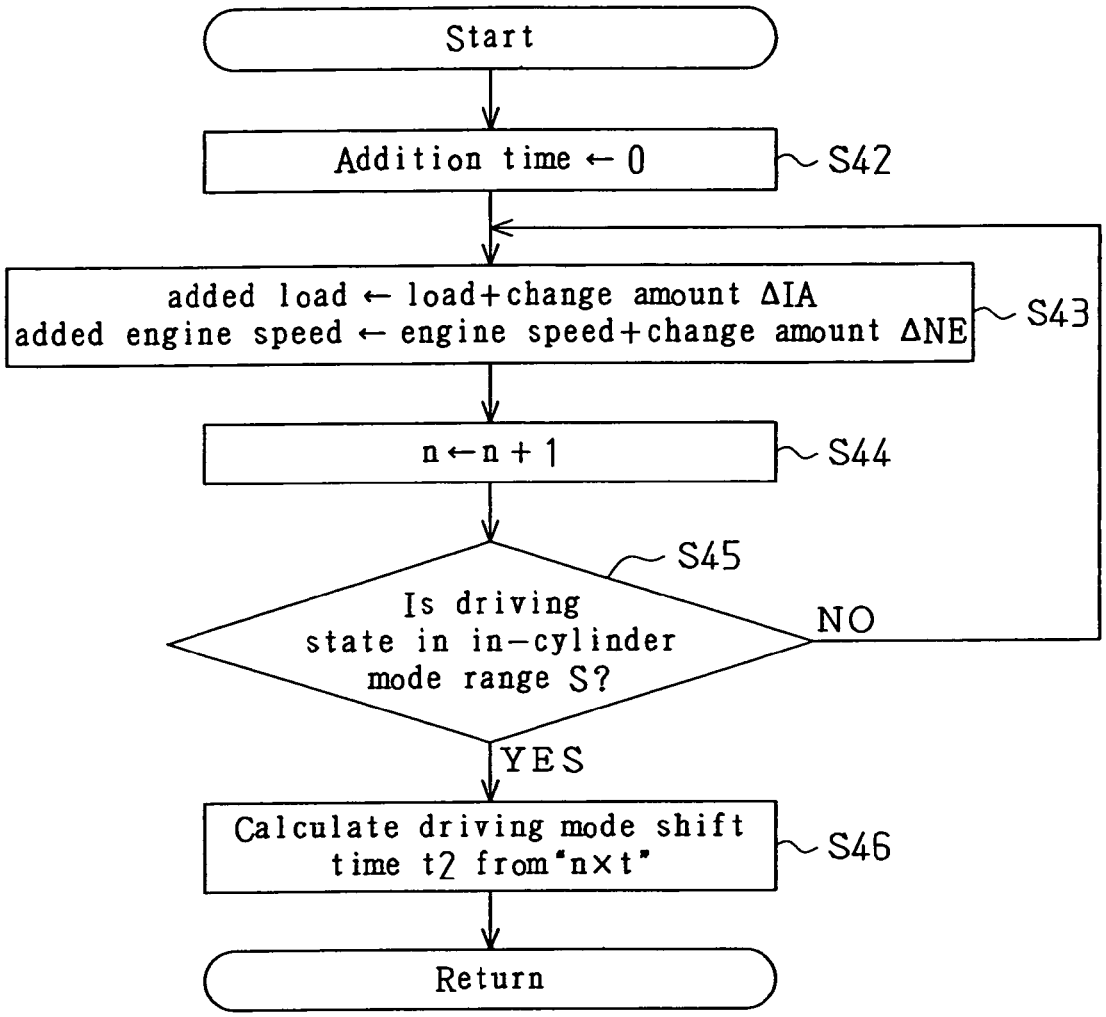
FIG. 7 is a flowchart showing a process for calculating the time required for the driving state of the internal combustion engine to reach a specific drive range.

Referring to FIG. 7, the ECU 100 resets the addition time n to zero in step S42. In step S43, the ECU 100 adds the change amount ΔIA and the change amount ΔNE respectively to the present engine load and the present engine speed. In step S44, the ECU 100 adds one to the addition number n. In step S45, the ECU 100 determines whether the driving state corresponding to the engine load and the engine speed resulting from the addition is in the in-cylinder injection mode range S. When the result in step S45 is NO, the ECU 100 returns to step S43. From the second time step S43 is performed, the ECU 100 further adds the change amount ΔIA and the change amount ΔNE respectively to the engine load and the engine speed obtained in the previous routine. Every time the addition is performed, the ECU 100 adds one to the addition number n in step S44. The ECU 100 repeats steps S43 and S44 until the result in step S45 becomes YES. In step S46, the ECU 100 multiplies the addition number n and the time t to obtain the driving mode shift time t2.

The internal combustion engine controller of the preferred embodiment has the advantages described below.

(1) When predicting that the driving state will shift from the port injection mode to the in-cylinder injection mode is predicted (YES in step S30), the high-pressure pump 20 is actuated (S40). However, when predicting that the driving state will not shift to the in-cylinder injection (NO in step S30), the high-pressure pump 20 is not actuated (S85). This prevents the fuel efficiency of the internal combustion engine from being lowered. Also, since the pressure in the high-pressure distribution pipe 22 is raised, fuel is injected in a stable manner even immediately after shifting to the in-cylinder injection mode.

(2) When it is determined that the shifting of the driving state to the in-cylinder injection mode will be completed before the fuel pressure in the high-pressure distribution pipe 22 reaches the target pressure (YES in step S50), the changing of the driving state is suppressed (S70). More specifically, the opening degree of the throttle valve is adjusted so that the driving mode shift time t2 is equal to the pressure raising time t1. Thus, the shifting from the port injection mode to the in-cylinder injection mode is performed in a state in which the fuel pressure in the high-pressure distribution pipe 22 has been already raised to the target pressure.

(3) When predicting that the driving state will not shift from the port injection mode to the in-cylinder injection mode and that the fuel pressure in the high-pressure distribution pipe 22 is higher than the upper limit pressure (YES in S90), the relief valve 24 is opened to lower the fuel pressure to the higher limit pressure or less (S100). Thus, fuel leakage of the in-cylinder injectors 23, which may be caused by an extremely high fuel pressure, does not occur during the port injection mode.

(4) The ECU 100 performs switching between the port injection mode and the in-cylinder injection mode based on the engine load and the engine speed, which are parameters relating to the intake air amount of the internal combustion engine. Further, the ECU 100 monitors change of the driving state (point α) in correspondence with the engine load and the engine speed of the map M, which defines the port injection mode range and the in-cylinder injection mode range. Thus, the ECU 100 easily and accurately predicts whether point α will move into the in-cylinder injection mode range.

It should be apparent to those skilled in the art that the present invention may be embodied in many other specific forms without departing from the spirit or scope of the invention. Particularly, it should be understood that the present invention may be embodied in the following forms.

The map M does not have to be used to predict the movement of the point α to the in-cylinder injection mode range in which in-cylinder injection is performed and to estimate the shift time t2 required for the shifting of the driving state to the in-cylinder injection mode. For example, the change of the point α or the locus of the point α may be expressed by functions, which are used to perform predictions and estimations. However, it is preferable that the map M be used to reduce the calculation load on the ECU 100.

The determination process in step S34 may be executed based only on the engine load change amount ΔIA.

The driving state (point α) may also be determined from the intake air amount of the internal combustion engine. The intake air amount relates to the switching between the port injection and the in-cylinder injection.

The shifting of the driving state to the in-cylinder injection mode does not have to be suppressed when the driving state is determined to be shifted to the in-cylinder injection mode before the fuel pressure in the high-pressure distribution pipe 22 is raised to the target pressure.

When the driving state will not shift from the port injection mode to the in-cylinder injection mode, instead of de-actuating the high-pressure pump 20, the high-pressure pump 20 may be operated so that its output is relatively low. For example, the high-pressure pump 20 may be actuated at a first pump output, when the driving state will shift from the port injection mode to the in-cylinder injection mode, and at a second pump output, which is lower than the first pump output when the driving state will not shift. This also prevents unnecessary driving of the high-pressure pump 20 from lowering the fuel efficiency of the internal combustion engine.

The internal combustion engine may have, instead of the air-intake passage injectors 19, an injector (e.g., a cold-start injector arranged in a surge tank) located in the intake passage upstream from where the intake passage branches to the intake port of each cylinder. The controller of the present invention is applicable to any internal combustion engine having an in-cylinder injector and an air-intake passage injector. The controller of the present invention is applicable to an internal combustion engine having a single cylinder.

The present examples and embodiments are to be considered as illustrative and not restrictive, and the invention is not to be limited to the details given herein, but may be modified within the scope and equivalence of the appended claims.

What is claimed is:

1. A controller for an internal combustion engine, wherein the internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a, fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector, the internal combustion engine having a first driving mode, in which fuel is injected only from the air-intake passage injector, and a second driving mode, in which fuel is injected from the in-cylinder injector, the controller comprising:

a prediction means for predicting whether the internal combustion engine will shift from the first driving mode to the second driving mode based on a driving state of the internal combustion engine; and a pump control means for controlling fuel pressure in the high-pressure pipe, the pump control means operating the high-pressure pump at a first output when the prediction means predicts that the internal combustion engine is likely to shift from the first driving mode to the second driving mode, and the pump control means de-actuating the high-pressure pump or operating the high-pressure pump at a second output lower than the first output when the prediction means predicts that the internal combustion engine is not likely to shift from the first driving mode to the second driving mode.

2. The controller according to claim 1, further comprising:

a determination means for determining, when the prediction means predicts that the internal combustion engine is likely to shift to the second driving mode, whether the shifting to the second driving mode will be completed before the operation of the high-pressure pump raises the fuel pressure in the high-pressure pipe to a target pressure; and a suppression means for suppressing change of the driving state when the determination means determines that the shifting to the second driving mode will be completed before the fuel pressure is raised to the target pressure.

3. The controller according to claim 1, wherein the internal combustion engine further includes a relief valve for releasing the fuel in the high-pressure pipe, the controller further comprising:

a valve drive means for driving the relief valve to lower the fuel pressure in the high-pressure pipe when, while the fuel is being injected only from the air-intake passage injector, the prediction means predicts that the internal combustion engine will not shift from the first driving mode to the second driving mode and the fuel pressure in the high-pressure pipe is higher than a predetermined pressure.

4. The controller according to claim 1, wherein the prediction means monitors an intake air amount of the internal combustion engine or a parameter relating to the intake air amount to predicts whether the internal combustion engine is likely to shift to the second driving mode.

5. The controller according to claim 4, wherein the prediction means has a map associating the range of each driving mode with load of the internal combustion engine and with engine speed of the internal combustion engine, the prediction means monitoring movement of a point on the map determined by the load and the engine speed to predict whether the internal combustion engine shifts to the second driving mode.

6. The controller according to claim 5, wherein the prediction means shares the map with the determination means, and the determination means estimates the time required to shift to the second driving mode by monitoring movement of the point on the map determined by the load and the engine speed.

7. A controller for an internal combustion engine, wherein the internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a fuel tank and discharging low-pressure fuel, a low-pressure pipe for supplying the low-pressure fuel to the air-intake passage injector, a high-pressure pump for pressurizing the low-pressure fuel and discharging high-pressure fuel, and a high-pressure pipe for supplying the high-pressure fuel to the in-cylinder injector, the internal combustion engine having a first driving mode, in which fuel is injected only from the air-intake passage injector, and a second driving mode, in which fuel is injected from the in-cylinder injector, the controller comprising:

a pressure sensor for detecting pressure of the fuel in the high-pressure pipe and generating a detection signal according to the detected pressure; and a computer for controlling the high-pressure pump according to the detection signal of the pressure sensor, wherein the computer:

predicts whether the internal combustion engine is likely to shift from the first driving mode to the second driving mode based on a driving state of the internal combustion engine, operates the high-pressure pump at a first output when predicting that the internal combustion engine is likely to shift from the first driving mode to the second driving mode, and de-actuates the high-pressure pump or operates the high-pressure pump at a second output lower than the first output when predicting that the internal combustion engine is not likely to shift from the first driving mode to the second driving mode.

8. The controller according to claim 7, wherein when the internal combustion engine is likely to shift to the second driving mode, the computer determines whether the shifting to the second driving mode will be completed before the operation of the high-pressure pump raises the fuel pressure in the high-pressure pipe to a target pressure, and wherein the computer suppresses change of the driving state when the computer determines that the shifting to the second driving mode will be completed before the fuel pressure is raised to the target pressure.

9. The controller according to claim 7, wherein the internal combustion engine further includes a relief valve, arranged between the high-pressure pipe and the fuel tank, for returning the fuel in the high-pressure pipe to the fuel tank, and the computer drives the relief valve to lower the fuel pressure in the high-pressure pipe when, while the fuel is being injected only from the air-intake passage injector, the computer predicts that the internal combustion engine is not likely to shift from the first driving mode to the second driving mode and the fuel pressure in the high-pressure pipe is higher than a predetermined pressure.

10. The controller according to claim 7, wherein the computer monitors an intake air amount of the internal combustion engine or a parameter relating to the intake air amount to predicts whether the internal combustion engine is likely to shift to the second driving mode.

11. The controller according to claim 10, wherein the computer has a map associating the range of each driving mode with load of the internal combustion engine and with engine speed of the internal combustion engine, the computer monitoring movement of a point on the map determined by the load and the engine speed to predict whether the internal combustion engine shifts to the second driving mode.

12. The controller according to claim 11, wherein the computer monitors movement of the point on the map determined by the load and the engine speed to estimate the time required to shift to the second driving mode.

13. A controller for an internal combustion engine, wherein the internal combustion engine includes a combustion chamber, an in-cylinder injector for directly injecting fuel into the combustion chamber, an air-intake passage injector for injecting fuel to a position upstream from the combustion chamber, a low-pressure pump for pumping fuel from a fuel tank and supplying low-pressure fuel to the air-intake passage injector, and a high-pressure pump for pressurizing the low-pressure fuel and supplying high-pressure fuel to the in-cylinder injector, the internal combustion engine having a plurality of driving modes including a first driving mode, in which fuel is injected only from the air-intake passage injector, and a second driving mode, in which fuel is injected from the in-cylinder injector, the controller comprising:

a pressure sensor for detecting pressure of the high-pressure fuel and generating a detection signal according to the detected pressure; and a computer for adjusting output of the high-pressure pump according to the detection signal of the pressure sensor, wherein the computer is programmed to:

predict whether the internal combustion engine will exit from the first driving mode based on a driving state of the internal combustion engine, operate the high-pressure pump at a first output when predicting that the internal combustion engine is likely to exit from the first driving mode, and de-actuate the high-pressure pump or operate the high-pressure pump at a second output lower than the first output when predicting that the internal combustion engine will remain in the first driving mode.

14. The controller according to claim 13, wherein when the computer predicts that the internal combustion engine is likely to shift to the second driving mode, the computer is programmed to determine whether the shifting to the second driving mode will be completed before the operation of the high-pressure pump raises the fuel pressure in the high-pressure pipe to a target pressure, and wherein the computer is programmed to suppress change of the driving state when the computer determines that the shifting to the second driving mode will be completed before the fuel pressure is raised to the target pressure.

15. The controller according to claim 13, wherein the internal combustion engine further includes a relief valve, arranged between the high-pressure pipe and the fuel tank, for returning the fuel in the high-pressure pipe to the fuel tank, and the computer is programmed to drive the relief valve to lower the fuel pressure in the high-pressure pipe when, while the fuel is being injected only from the air-intake passage injector, the computer predicts that the internal combustion engine is not likely to shift from the first driving mode to the second driving mode and the fuel pressure in the high-pressure pipe is higher than a predetermined pressure.

16. The controller according to claim 13, wherein the computer is programmed to predicts whether the internal combustion engine is likely to shift to the second driving mode by monitoring an intake air amount of the internal combustion engine or a parameter relating to the intake air amount.

17. The controller according to claim 16, wherein the computer has a map associating the range of each driving mode with load of the internal combustion engine and with engine speed of the internal combustion engine, the computer is programmed to predict whether the internal combustion engine shifts to the second driving mode by monitoring movement of a point on the map determined by the load and the engine speed.

18. The controller according to claim 17, wherein the computer monitoring movement of the point on the map determined by the load and the engine speed to estimate the time required to shift to the second driving mode.

* * * * *